US005341874A

United States Patent [19]

Wilson

[11] Patent Number: 5,341,874

[45] Date of Patent: Aug. 30, 1994

[54] RETRIEVABLE PACKER

[76] Inventor: Christopher C. Wilson, 129 Cliff Dr., Gray, Tenn. 37615

[21] Appl. No.: 951,225

[22] Filed: Sep. 25, 1992

[51] Int. Cl.[5] ..... E21B 23/06; E21B 33/128

[52] U.S. Cl. ..... 166/196; 166/72; 166/120; 166/188

[58] Field of Search ..... 166/196, 188, 120, 142, 166/122, 72

[56] References Cited

U.S. PATENT DOCUMENTS

| | | | |
|---|---|---|---|
| 978,359 | 12/1910 | Cooper . | |
| 995,250 | 6/1911 | Graham . | |
| 2,178,844 | 11/1939 | Baker | 166/142 |
| 2,189,697 | 2/1940 | Baker | 166/12 |
| 2,228,241 | 1/1941 | Baker et al. | 166/120 |
| 2,228,630 | 1/1941 | Kail | 166/13 |
| 2,263,563 | 11/1941 | Boynton | 166/1 |
| 2,270,648 | 1/1942 | Church | 166/120 |
| 2,416,842 | 3/1947 | O'Leary | 166/1 |
| 2,624,412 | 1/1953 | Ragan | 166/120 |
| 3,055,430 | 9/1962 | Campbell | 166/196 X |
| 3,213,940 | 10/1965 | Wood | 166/289 |
| 4,403,656 | 9/1983 | Ploeg | 166/179 |
| 4,403,660 | 9/1983 | Coone | 166/196 X |
| 5,014,782 | 5/1991 | Daspit | 166/120 |

*Primary Examiner*—Hoang C. Dang
*Attorney, Agent, or Firm*—Pitts & Brittian

[57] ABSTRACT

A retrievable packer 10 for isolating a selected depth of a wall of a borehole. The retrievable packer is comprised of a body member 12, a cylinder 32 surrounding the upper portion of the body member 12, and a sealing member 24 cylindrically surrounding the lower portion of the body member. The cylinder 32 and the upper portion of the body member 12 work in conjunction to provide a piston action which engages the sealing member 24 and causes the sealing member 24 to establish a seal with the wall of the borehole.

21 Claims, 4 Drawing Sheets

RETRIEVABLE PACKER

DESCRIPTION

Field of Invention

The present invention relates to packers, and in particular to packers used in wells in which the entire assembly is retrievable upon removal from the well.

Background Art

In general, packers are utilized in the water and oil well industries to "pack off" or isolate a well at a selected location. The isolation of a selected point is often necessary to complete many well operations. For example, packers are utilized in the cementing operation of a casing to a borehole. In a cementing operation, the annular space between the casing and the borehole is filled with cement. This is done by isolating the bottom of the casing and pumping cement through the interior of the packer out the bottom and up through the annular space.

Packers are also used to monitor the ground water at specific locations throughout the depth of the well. To be assured that a sample is representative of the depth at which it is taken, the depth is isolated via a packer. Another use of a packer is in a hydro-fracturing operation, wherein high pressure water is injected into a well to increase the size and extent of existing fractures thereby increasing the yield of the well. The well must be packed off to obtain the high pressures within the well necessary for such an operation.

Because of the variety of uses of packers, the industry has attempted to design a packer which is versatile to serve a number of functions in the oil and water well industries.

Typical of the known background art are the patents listed in the following table.

| U.S. Pat. No. | Inventor | Date |
|---|---|---|
| 978,359 | A. S. Cooper | December 13, 1910 |
| 995,250 | A. C. Graham | June 13, 1911 |
| 2,189,697 | R. C. Baker | February 6, 1940 |
| 2,228,630 | R. S. Kail | January 14, 1941 |
| 2,263,563 | A. Boynton | November 25, 1941 |
| 2,416,842 | C. M. O'Leary | March 4, 1947 |
| 4,403,656 | J. F. Ploeg | September 13, 1983 |

The '359 patent teaches a method of cementing wells wherein a mixture of asphalt and sulfur is used to adhere a casing to a borehole. The asphalt/sulfur mixture is melted upon heating and through pressure forced to fill the annular space between the casing and the borehole.

The '250 and the '697 patents discuss packers in which the anchoring portion of the packer is permanently anchored in the casing. After the cementing operation, the cement setting tool or flow mandrel can be removed from the packer without disturbing the anchoring portion. These devices can be used for a bridge packing to seal off the interior of a well casing. If it is desired to continue further down the borehole the anchoring portion and cement plug must be drilled out.

The '630 patent teaches a cementing plug that can move down through a casing and eject a preceding charge of cement from the casing. The cementing plug becomes anchored to the casing against upward movement which prevents reverse flow of the charge of cement. Again, if it desired to continue further down the borehole the cement plug must be drilled.

The '566 patent discusses a cementing device in which a casing is supported above a cementing assembly and a liner is supported below the cementing assembly. A seal is formed between the cementing assembly and the borehole. The casing and the upper portion of the cementing assembly are adhered to the borehole through the cementing operation. To obtain an open passage through the casing and liner, the cementing assembly must be drilled out.

The '842 patent teaches a well cementing apparatus which is comprised of a complex anchoring mechanism, a retriever and a cementing valve assembly. The retriever is used to trigger the means to anchor the packer to a casing and to remove the packer upon completion of the cementing operation. Upon removal of the packer, the boot of the cementing assembly and a plug of cement remain in the casing, this must be drilled out to open the borehole.

The '656 patent teaches a thermal packer to be placed permanently in a steam injection well between the inside of the casing of the well and the outside of the steam injection tubing. It resolves the problems that occur with standard inflatable packers and their failure to maintain a tight seal at high temperatures and pressures.

In general, a packer is comprised of at least an anchoring portion and a flow conduit through which fluid may pass. As discussed in the background art, the anchoring portions of removable packers are complex in design relying on several different components which must work in conjunction to obtain a seal between the packer and the casing. In recent years, inflatable packers, wherein the anchoring portion is inflatable, have become widely popular due to the ease of use of such packers and because they are constructed for repeated use. The inflatable packer can be used in several different well operations including ground water monitoring, permeability testing and grouting of a casing to a borehole. The main disadvantage to using an inflatable packer in a cementing or grouting operation is that cement is left in the casing which must be drilled out to obtain a free passage through the casing string.

Therefore, it is an object of this invention to provide a retrievable packer which is entirely removable from the borehole or casing upon completion of use.

It is a further object of this invention to provide such a packer which provides a simple and effective method for isolating a selected location within a borehole or casing.

It is still a further object of this invention to provide such a packer which upon removal from the casing leaves no cement to be drilled out to obtain a free passage through the casing string.

It is yet a further object of this invention to provide a packer which has washout means in which cement left in the packer can be washed out after a cementing operation such that the packer can be used again.

DISCLOSURE OF INVENTION

Other objects and advantages will be accomplished by the present invention which provides a packer which can isolate a selected location within a borehole or casing. The packer can be used in a cementing operation and, upon the setting of the cement, can be removed in its entirety from a casing without leaving a cement plug or portions of the packer in the casing that must be drilled out to obtain a free passage through the casing. The retrievable packer further supplies means for washing out the body member after a cementing operation, while the packer remains in the casing and continues to retain a seal.

The retrievable packer is comprised, in general, of a body member, a cylinder, which surrounds substantially the upper portion of the body member and a sealing member, which cylindrically surrounds substantially the lower portion of the body member.

The body member is cylindrical in shape and extends the length of the packer. A fluid delivery tube can be received by the body member. Preferably, it is received at the top of the body member. The body member carries a valve assembly at its lower end which prevents back flow of fluid into the body member from below the packer.

The cylinder surrounds substantially the upper portion of the body member. It operates in conjunction with the upper portion of the body member to supply a piston action, which engages the sealing member.

The sealing member is supported at its lower end by the body member. The sealing member is engaged at its upper end by the lower end of the cylinder. In the preferred embodiment, the sealing member is fabricated from an elastomeric material such as rubber.

The piston action of the upper portion of the packer is activated by filling a chamber, defined by the cylinder, with a pressurized fluid and particularly a gas. As the chamber is filled, the cylinder is forced downward upon the upper end of the sealing member. This action causes the sealing member to compress and its central portion to expand out, contact and seal the packer to the wall of the well.

Once the packer's sealing member has engaged the wall of the well, the operation of choice can be conducted.

BRIEF DESCRIPTION OF DRAWINGS

The above mentioned features of the invention will become more clearly understood from the following detailed description of the invention read together with the drawings in which.

BEST MODE FOR CARRYING OUT THE INVENTION

Figure 1:
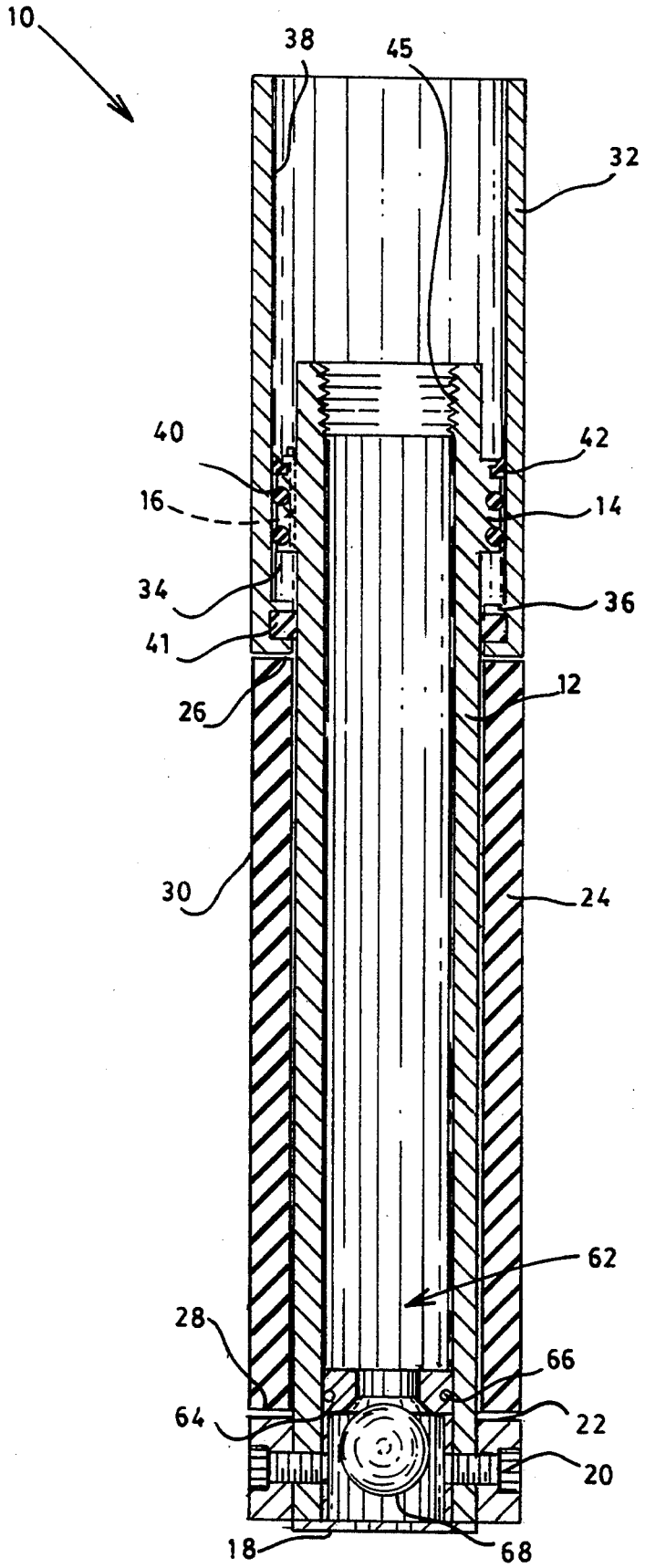
FIG. 1 is a perspective view of the retrievable packer constructed in accordance with several features of the present invention.

A retrievable packer 10 incorporating various features of the present invention is illustrated at 10 in FIG. 1. The retrievable packer 10 is comprised, in general, of a body member 12, which extends substantially the length of the packer 10, a cylinder 32, which surrounds the upper portion of the body member 12 and a sealing member 24, which cylindrically surrounds the lower end of the body member 12.

The body member 12 defines a location 45 to which a fluid delivery tube 44 can be attached, for delivering fluid to the packer 10. The fluid delivery tube 44 can also be utilized as a lowering device to lower the packer 10 into a borehole 72 or casing 70. The body member 12 further defines a piston head 14, which is carried at an upper location on the body member 12. The body member 12 also carries a valve assembly at its lower end to prevent back flow of fluid into the body member 12. The body member 12 further defines a support shoulder 22 at its lower end.

The cylinder 32 surrounds the upper portion of the body member 12 including the piston head 14. A seal 40 is established between the piston head 14 and the inner surface 38 of the cylinder 32. In the preferred embodiment, this seal is established by two O-rings. Preferably, a cylinder wiper 42 is installed at the junction of the top edge of the piston head 14 and the inner surface 38 of the cylinder 32 to prevent any contaminants on the inner surface 38 of the cylinder 32 above the piston head 14 from entering the sealed portion of the piston head 14 and the cylinder 32.

The cylinder 32 defines a shoulder 36 at its lower end. A seal 41 is established between the cylinder shoulder 36 and the body member 12. In the preferred embodiment, this seal is a POLY PAK seal. As shown in FIG. 1, the seal 41 is an o-ring type seal and a POLY PAK seal is simply an o-ring within a housing.

The cylinder 32 further defines an expandable chamber 34, which is located between the bottom of the piston head 14 and the upper surface of the cylinder shoulder 36. The chamber 34 can be filled with a pressurized fluid and preferably a gas (hereinafter "gas") via a conduit 16 which runs through the piston head 14 and opens into the chamber 34.

The upper portion of the packer 10 is employed as a piston to engage the sealing member 24 wherein the cylinder 32 is the moving cylinder of the piston and the piston head 14, which is an extension of the body member 12, remains stationary.

The sealing member 24, which cylindrically surrounds the lower portion of the body member 12, is comprised in general of an upper 26 and lower end 28 and a central portion 30. The cylinder shoulder 36 engages the upper end 26 of the sealing member 24. The lower end 28 of the sealing member 24 is supported by the support shoulder 22 of the body member 12. In the preferred embodiment the sealing member 24 is fabricated from an elastomeric material such as rubber.

To employ the packer 10, it is lowered into a borehole 72 having a wall which can be an earthen wall 73 or the wall 71 of a casing 70. The packer is lowered to the desired depth. The piston activated sealing member 24 is engaged to anchor the packer 10 in the casing 70 or borehole 72 such that packer isolates the casing wall 71 or earthen wall 73 at the desired depth.

Figure 2:
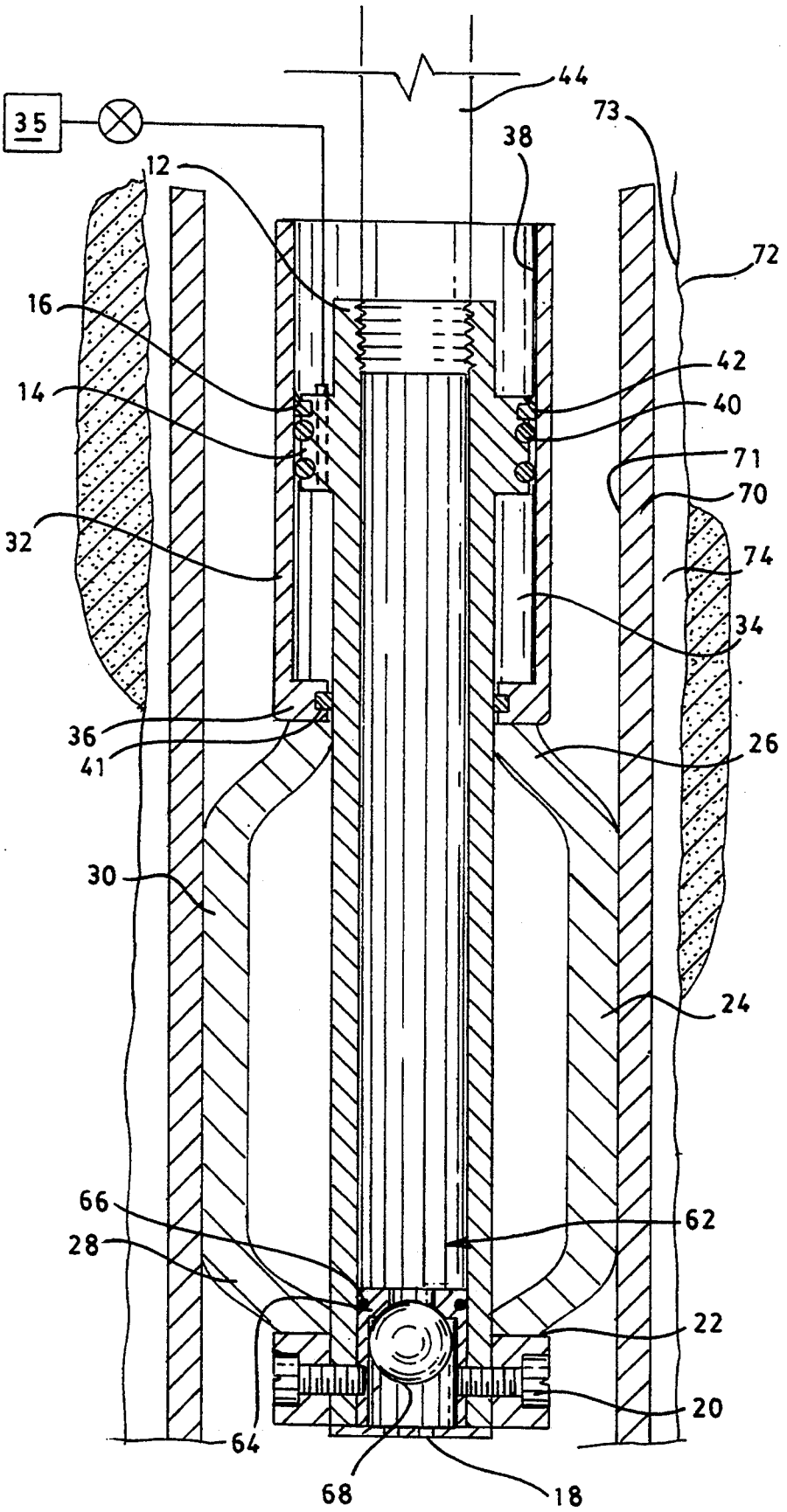
FIG. 2 is a perspective view of the retrievable packer of FIG. 1 wherein the sealing member is compressed.

To activate the piston, the chamber 34 is filled via a pressurized gas source 35. In the preferred embodiment, the pressurized gas is nitrogen gas. As the chamber 34 expands, it forces the cylinder shoulder 36 downward. The upper end 26 of the sealing member 24 is forced downward toward the lower end 28 causing the central portion 30 of the sealing member 24 to expand and contact the borehole wall. As shown in FIG. 2, the central portion 30 creates a seal between a casing wall 71 and the packer 10.

A cementing operation is one of many applications for a packer. A cementing operation entails cementing a casing 70 to a borehole 72 by filling the annular space 74 with cement. The cement is delivered under pressure and flows through the fluid delivery tube 44 and exits the lower end of the body member 12.

Once the annular space 74 is filled, the cement delivery is stopped. To prevent back flow of fluid into the body member 12 a valve assembly is positioned at the lower end of the body member 12. In the preferred embodiment, the valve assembly is a floating ball valve assembly 62, which serves as a check valve, including a seat member 64 and a check ball 68. The seat member 64 is situated on the inner surface of the lower end of the body member 12. The check ball 68 is situated below the seat member 64 and is retained in the body member 12 by an endplate 18. The endplate 18 is mounted on the support shoulder 22 of the body member 12 and constructed such that there are several openings through which the cement can flow. In the preferred embodiment, the endplate 18 is mounted at the bottom of the support shoulder 22 via three bolts 20 which also secure the floating ball valve assembly 62 in the body member 12. In the preferred embodiment, the seat member 64 is further sealed to the inner wall of the body member 12 with an O ring 66. Any back flow pressure from a fluid will force the check ball 68 upward against the seat member 64 and prevent any fluid from flowing back into the body member 12. Because of this back flow pressure, the packer 10 must maintain a seal and remain in the casing 70 until the cement has set properly.

Because it is a desire to reuse the packer 10, a washout operation takes place immediately after the cementing operation, to remove the cement remaining in the body member 12.

Figure 3:
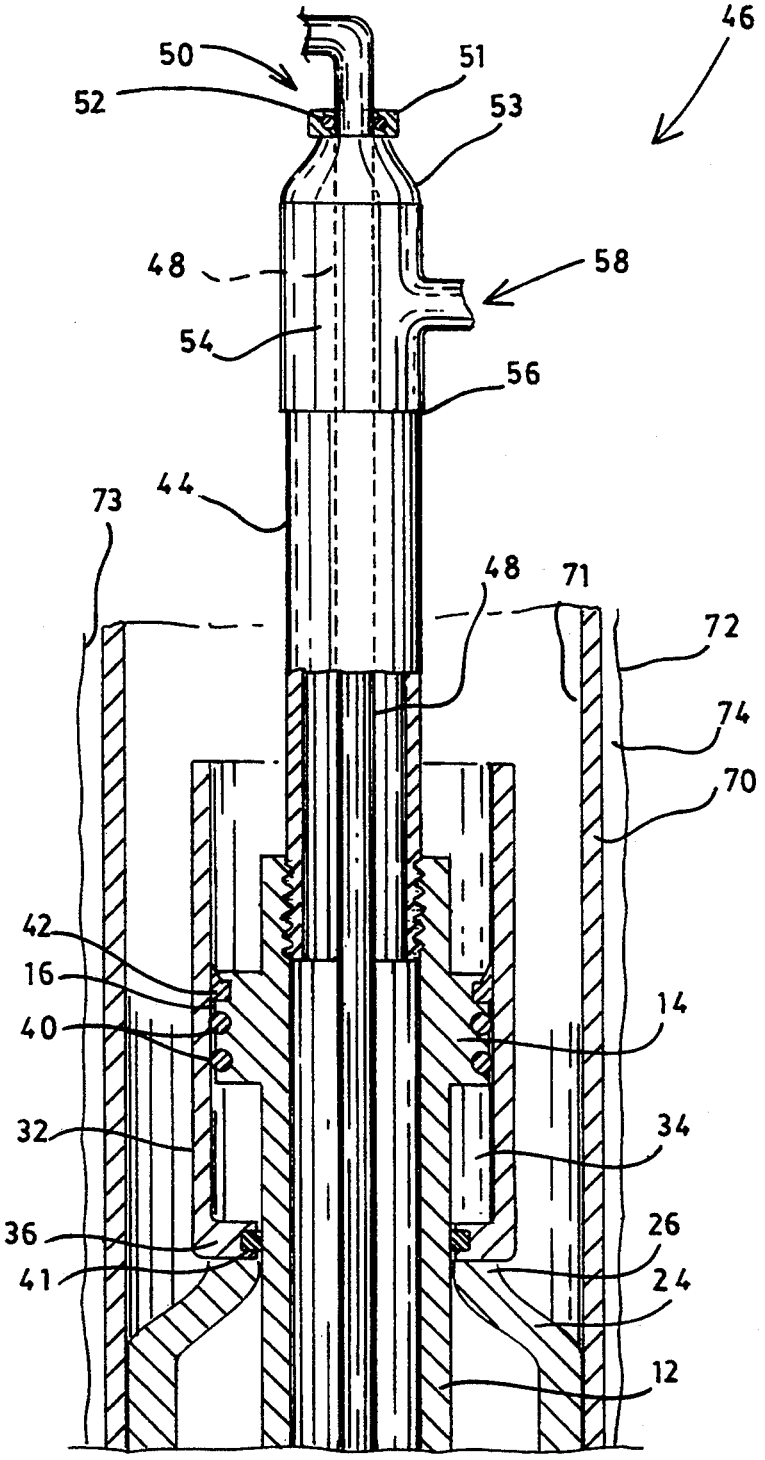
FIG. 3 is a perspective view of an embodiment of the washout assembly.

In a preferred embodiment, the washout operation is conducted using a washout assembly, shown generally at 46 in FIG. 3. The washout assembly 46 is comprised generally of a washout tube 48, and a washout tee 54. In the preferred embodiment, the washout tee 54 is comprised of three openings, two through which the washout tube 48 travels and one opening is an outlet 58. The washout tee 54 is secured via a seal 56 to the fluid delivery tube 44. The washout tube 48, which is of a smaller diameter than the fluid delivery tube 44, is lowered through the washout tee 54 and into the fluid delivery tube 44 until the washout tube 48 rests on the seat member 64. In the preferred embodiment, the washout tube 48 is fabricated from polyvinyl chloride (PVC). A seal 50 between the washout tube 48 and the washout tee 54 is established. In the preferred embodiment, a compression adaptor 53 is used to establish the seal, the compression adaptor 53 also serves to hold the washout tube 48 in place. Preferably, a jam nut 51 and a rubber compression washer 52 are placed around the washout tube 48 and on top of the adaptor 53 to strengthen the seal 50. The remaining opening of the washout tee 54 provides an outlet 58 for the waste water and cement.

Once the washout assembly 46 is set up, wash fluid is pumped into the washout tube 48. In the preferred embodiment, the wash fluid is water. The water travels down the washout tube 48 and exits at the bottom of the tube 48 which is resting on the seat member 64. The water pressure forces the cement and water up the body member 12 through the fluid delivery tube 44 and exits the outlet 58 of the washout tee 54. When the water runs relatively clear it is an indication that the body member 12 is relatively cleared of cement and the flow of water is terminated. After the washout operation is complete, the washout assembly 46 can be dismantled and removed.

Figure 4:
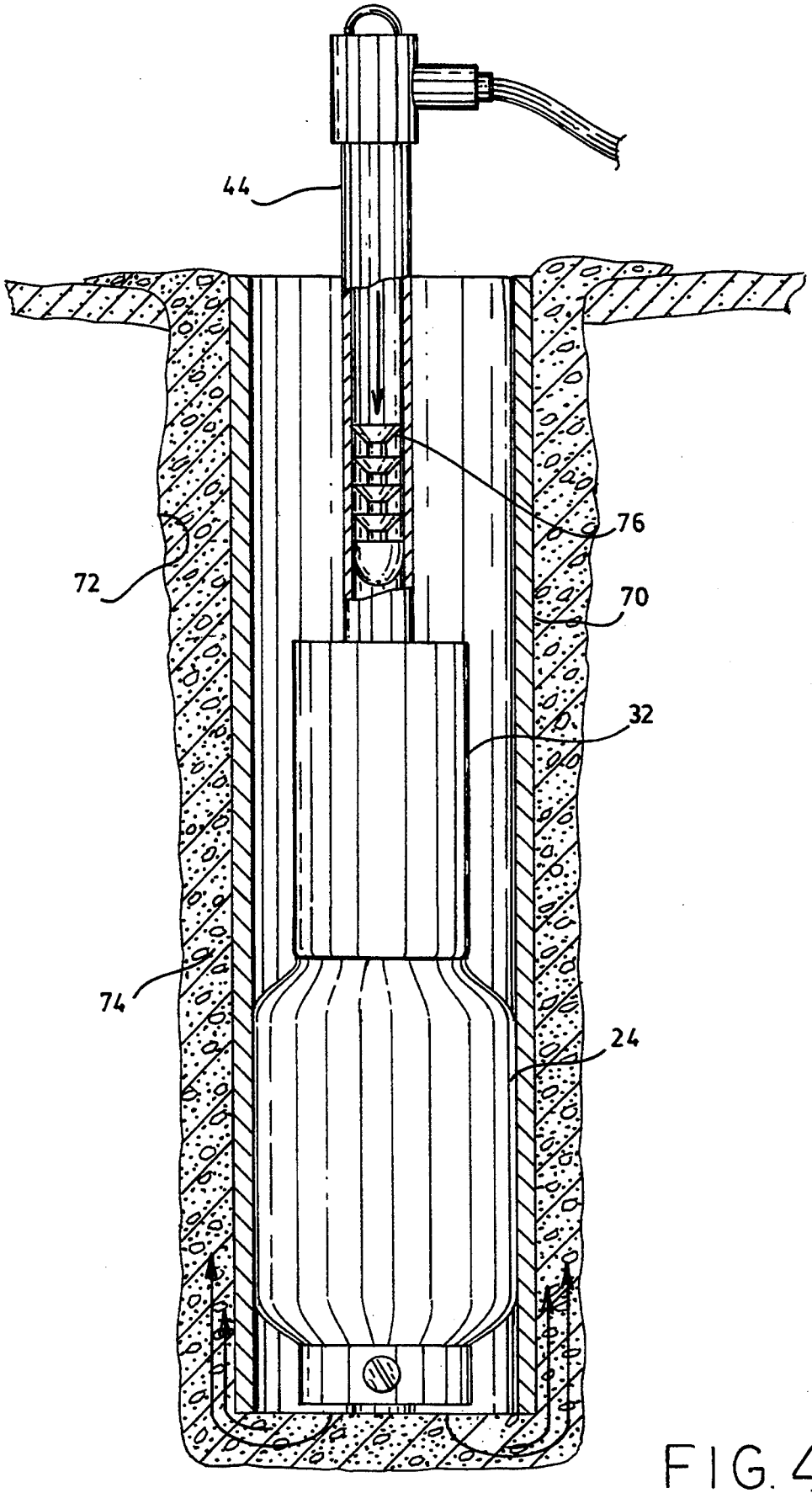
FIG. 4 is a perspective view of an alternate embodiment of the washout assembly.

In an alternate embodiment, the washout operation is conducted using a cleanout plug 76 as shown in FIG. 4. The cleanout plug 76 has a diameter slightly larger than the inner diameter of the body member 12 and the fluid delivery tube 44. The cleanout plug 76 is inserted into the fluid delivery tube 44 after the cement flow has been terminated. A washout fluid such as water is forced into the fluid delivery tube 44 and forces the cleanout plug 76 downward through the fluid delivery tube 44 and body member 12. The cleanout plug 76 is sealed to the interior wall of the fluid delivery tube 44 and body member 12 such that the washout fluid above the cleanout plug 76 and the cement below the cleanout plug 76 can not mix while the cleanout plug 76 is forced down through the packer 10. As the cleanout plug 76 is forced downward the cement below the plug 76 is forced downward and out the packer 10. The cleanout plug 76 will rest at the bottom of the body member 12 until the packer 10 is removed from the casing 70.

After enough time has elapsed for the cement to become immobile, the nitrogen in the expandable chamber 34 is bled off through an exit valve at the regulator of the compressed gas. The sealing member 24 releases its seal against the casing wall 71 and returns to substantially its starting position. Subsequently, the packer 10 can be removed from the casing 70 in its entirety, any cement remaining outside the packer 10 in the casing 70 is brought up with the packer 10 and, therefore, there is no cement plug left in the borehole 72 which must be drilled out.

The packer 10 described is not limited to being solely used in a cementing or grouting operation. Another use is in the testing of groundwater for contaminants. To run a test of the groundwater at a particular depth, a cementing operation is conducted wherein the casing 70 is placed at the depth at which the ground water will be tested. Because the cement is introduced at the bottom of the casing 70, it forces any contaminants or dirt above the bottom of the casing 70 up through the annular space 74 and out the borehole 72. Therefore, one is certain that the sample of water taken at the bottom of the casing 70 is a sample of the water at that particular depth.

It will be recognized by those skilled in the art that the retrievable packer 10 described can be used, in conjunction with a hook wall device, to test formation permeability or to hydro-fracture a borehole 72, which are high pressure operations. In such operations, the packer 10 is anchored in a rock borehole 72 and held in place against high pressure and high volume water with a hook wall device.

From the foregoing description, it will be recognized by those skilled in the art that a retrievable packer offering advantages over the prior art has been provided. Specifically, the retrievable packer provides a means for easily anchoring the packer in a casing or borehole. Further, the retrievable packer provides means for washing out any cement left in the body member and delivery tube after a cementing operation, while the packer remains in the casing and maintains a pressure against the cement in the annular space until a time sufficient enough to allow the cement to set. Finally, upon removal from the casing after a cementing operation there is no cement which must be drilled out to obtain a free passage through the casing.

While a preferred embodiment has been shown and described, it will be understood that it is not intended to limit the disclosure, but rather it is intended to cover all modifications and alternate methods falling within the spirit and the scope of the invention as defined in the appended claims and equivalents thereof.

I claim:

1. A packer for isolating a selected depth of a borehole having a wall, said packer comprising:

a body member having a first end and a second end, said body member defining a passage therethrough for fluid communication and including a piston having a piston head;

a cylinder slidably receiving said piston head, said cylinder defining a shoulder proximate said piston had and defining a chamber between said piston head and said shoulder, said chamber being sealed from communication with said passage of said body member;

a sealing member carried by said body member having an upper end proximate said shoulder of said cylinder;

a pressurized fluid source for injecting a pressurized fluid into said chamber to cause expansion of said chamber thereby forcing said cylinder downward such that said shoulder of said cylinder is forced against said upper end of said sealing member causing expansion of said sealing member against said wall of said borehole;

a fluid delivery tube removably connected to said first end of said body member for delivering a second fluid to said passage of said body member; and, a valve assembly carried by said body member proximate said second end to prevent back flow from exterior of said body member into said body member.

2. The packer of claim 1 wherein said sealing member is fabricated from an elastomeric material.

3. The packer of claim 1 wherein said sealing member is carried annularly about said body member.

4. The packer of claim 1 wherein said sealing member has a lower end supported by said second end of said body member.

5. The packer of claim 1 wherein said piston head is provided with an annular seal to seal against an inner surface of said cylinder.

6. The packer of claim 1 wherein said shoulder of said cylinder is provided with an annular seal against an outer surface of said body member.

7. The packer of claim 1 wherein said wall of said borehole is a casing, said casing being inserted into said borehole, said second fluid delivered through said fluid delivery tube to said passage of said body member being cement for sealing an annular space between said casing and said borehole.

8. The packer of claim 7 wherein said packer further comprises a washing means for washing cement from said fluid delivery tube and said body member following said sealing of said annular space with said cement.

9. The packer of claim 8 wherein said washing means comprises:

a washout tee having a first end and a second end, said washout tee defining at least one outlet and a passage therethrough from said first end to said second end, said second end of said washout tee being releasably engaged to said fluid delivery tube;

a washout tube passing through said passage of said washout tee and through said fluid delivery tube and said body member whereby a wash solution can be passed through said washout tube into said fluid delivery tube and said body member and out through said outlet of said washout tee to remove remaining cement in said delivery tube and said body member; and, a seal disposed at said first end of said washout tee and surrounding said washout tube to prevent escape of said wash solution at said first end of said washout tee.

10. The packer of claim 8 wherein said washing means comprises a plug slidably sealed to an inner surface of said fluid delivery tube and said body member, said plug being forced downward through said fluid delivery tube and said body member via a pressurized washing fluid source.

11. A packer for isolating a selected depth of a borehole and for cementing a casing to said borehole, said casing having a wall, said packer comprising:

a body member having a first end and a second end, said body member defining a passage therethrough for fluid communication and including a piston having a piston head;

a cylinder slidably receiving said piston head, said cylinder defining a shoulder proximate said piston head and defining a chamber between said piston head and said shoulder, said chamber being sealed from communication with said passage of said body member;

a sealing member carried annularly by said body member having an upper end proximate said shoulder of said cylinder and a lower end supported by said second end of said body member, said sealing member being fabricated from an elastomeric material;

a pressurized fluid source for injecting a pressurized fluid into said chamber to cause said chamber to expend thereby forcing said cylinder downward such that said shoulder of said cylinder is forced against said upper end of said sealing member causing expansion of said sealing member against said wall of said casing;

a fluid delivery tube removably connected to said first end of said body member for delivering a second fluid to said passage of said body member, said second fluid being cement for sealing an annular space between said casing and said borehole; and, a valve assembly carried by said body member proximate said second end to prevent back flow from exterior of said body member into said body member.

12. The packer of claim 11 wherein said piston head is provided with an annular seal to seal against an inner surface of said cylinder.

13. The packer of claim 11 wherein said shoulder of said cylinder is provided with an annular seal against an outer surface of said body member.

14. The packer of claim 11 wherein said packer further comprises a washing means releasably attached to said body for washing cement from said fluid delivery tube and said body member following said sealing of said annular space with said cement.

15. The packer of claim 14 wherein said washing means comprises:

a washout tee having a first end and a second end, said washout tee defining at least one outlet and a passage therethrough from said first end to said second end, said second end of said washout tee being releasably engaged to said fluid delivery tube;

a washout tube passing through said passage of said washout tee and through said fluid delivery tube and said body member whereby a wash solution can be passed through said washout tube into said fluid delivery tube and said body member and out through said outlet of said washout tee to remove remaining cement in said delivery tube and said body member; and, a seal disposed at said first end of said washout tee and surrounding said washout tube to prevent escape of said wash solution at said first end of said washout tee.

16. The packer of claim 14 wherein said washing means comprises a plug slidably sealed to an inner surface of said fluid delivery tube and said body member, said plug being forced downward through said fluid delivery tube and said body member via a pressurized washing fluid source.

17. A packer for isolating a selected depth of a borehole and for cementing a casing to said borehole, said casing having a wall, said packer comprising:

a body member having a first end and a second end, said body member defining a passage therethrough for fluid communication and including a piston having a piston head;

a cylinder slidably receiving said piston head, said cylinder defining a shoulder proximate said piston head and defining a chamber between said piston head and said shoulder, said chamber being sealed from communication with said passage of said body member;

a sealing member carried annularly about said body member, said sealing member having an upper end proximate said shoulder of said cylinder;

a pressurized fluid source for injecting a pressurized fluid into said chamber to cause said chamber to expend thereby forcing said cylinder downward such that said shoulder of said cylinder is forced against said upper end of said sealing member causing expansion of said sealing member against said wall of said casing;

a fluid delivery tube removably connected to said first end of said body member for delivering a second fluid to said passage of said body member, said second fluid being cement for sealing an annular space between said casing and said borehole;

a valve assembly carried by said body member proximate said second end to prevent back flow from exterior of said body member into said body member; and, a washing means for washing cement from said fluid delivery tube and said body member following said sealing of said annular space with said cement, said washing means comprising a washout tee, a washout tube and a seal, said washout tee having a first end and a second end, said washout tee defining at least one outlet and a passage therethrough from said first end to said second end, said second end of said washout tee being releasably engaged to said fluid delivery tube, said washout tube passing through said passage of said washout tee and through said fluid delivery tube and said body member whereby a wash solution can be passed through said washout tube into said fluid delivery tube and said body member and out through said outlet of said washout tee to remove remaining cement in said delivery tube and said body member, said seal being disposed at said first end of said washout tee and surrounding said washout tube to prevent escape of said wash solution at said first end of said washout tee.

18. The packer of claim 17 wherein said sealing member is fabricated from an elastic material.

19. The packer of claim 17 wherein said sealing member has a lower end supported by said second end of said body member.

20. The packer of claim 17 wherein said piston head is provided with an annular seal to seal against an inner surface of said cylinder.

21. The packer of claim 17 wherein said shoulder of said cylinder is provided with an annular seal against an outer surface of said body member.

* * * * *